US010167170B2

(12) United States Patent
Kim

(10) Patent No.: US 10,167,170 B2
(45) Date of Patent: Jan. 1, 2019

(54) SMART ELEVATOR SYSTEM

(71) Applicant: MFS CORPORATION, Guro-gu, Seoul (KR)

(72) Inventor: Dong Gyun Kim, Seoul (KR)

(73) Assignee: MFS CORPORATION, Guro-gu, Seoul (KR)

( * ) Notice: Subject to any disclaimer, the term of this patent is extended or adjusted under 35 U.S.C. 154(b) by 0 days.

(21) Appl. No.: 15/391,592

(22) Filed: Dec. 27, 2016

(65) Prior Publication Data

US 2018/0111788 A1 Apr. 26, 2018

(30) Foreign Application Priority Data

Oct. 21, 2016 (KR) ..... 10-2016-0137706

(51) Int. Cl.
*B66B 3/00* (2006.01)
*B66B 3/02* (2006.01)
(Continued)

(52) U.S. Cl.
CPC ..... *B66B 1/2408* (2013.01); *B66B 1/468* (2013.01); *B66B 13/143* (2013.01);
(Continued)

(58) Field of Classification Search
CPC ..... H04W 4/80; H04W 12/08; H04W 88/02; H04W 4/025; B66B 2201/4653;
(Continued)

(56) References Cited

U.S. PATENT DOCUMENTS 8,401,472 B2 * 3/2013 Gerstenkorn ..... B66B 1/468 187/380
9,878,875 B1 * 1/2018 Scoville ..... B66B 1/468
(Continued)

FOREIGN PATENT DOCUMENTS

JP 2005-212923 A 8/2005
JP 2014152022 A 8/2014
(Continued)

OTHER PUBLICATIONS

Office Action corresponding to Korean Patent Application No. 10-2016-0137706, dated Mar. 19, 2018, five pages.
(Continued)

*Primary Examiner* — Marlon Fletcher
(74) *Attorney, Agent, or Firm* — Kilpatrick Townsend & Stockton

(57) ABSTRACT

A smart elevator system includes: an elevator provided in a building having multiple floors; a controller configured to control the elevator; a portable terminal used by a person to make a reservation for using the elevator and including a communicator for long-range communication and short-range communication; a server system configured to receive the reservation for using the elevator from the portable terminal by communicating with the portable terminal and control an operation of the elevator through the controller according to the reservation; and a portable terminal detector provided near a door of the elevator and configured to obtain a unique key of the portable terminal through the communicator, when the portable terminal used to make the reservation approaches it.

4 Claims, 4 Drawing Sheets

(51) Int. Cl.
*B66B 1/24* (2006.01)
*B66B 1/46* (2006.01)
*B66B 13/14* (2006.01)

(52) U.S. Cl.
CPC . *B66B 2201/103* (2013.01); *B66B 2201/4653* (2013.01); *B66B 2201/4676* (2013.01)

(58) Field of Classification Search
CPC ..... B66B 1/468; B66B 2201/4615; B66B 1/2408; B66B 2201/103; B66B 2201/4661; B66B 2201/4676; B66B 9/16
See application file for complete search history.

(56) References Cited

U.S. PATENT DOCUMENTS

2003/0159890 A1* 8/2003 Schuster ..... B66B 1/468 187/247
2006/0108181 A1* 5/2006 Bacellar ..... B66B 1/34 187/247
2006/0144644 A1* 7/2006 Chiba ..... B66B 1/34 187/380
2013/0153339 A1* 6/2013 Sarjanen ..... B66B 1/468 187/382
2016/0122157 A1* 5/2016 Keser ..... B66B 1/468 187/388
2016/0251198 A1* 9/2016 Salmikuukka ..... B66B 1/2458 187/388

FOREIGN PATENT DOCUMENTS

JP 2015168520 A 9/2015
KR 20140050853 A 4/2014

OTHER PUBLICATIONS

Office Action from related matter Korean Patent Application No. 10-2016-0137706, dated Sep. 27, 2018, all pages.

* cited by examiner

SMART ELEVATOR SYSTEM

CROSS-REFERENCE TO RELATED APPLICATION

This application claims the benefit of Korean Patent Application No. 10-2016-0137706, filed on Oct. 21, 2016, in the Korean Intellectual Property Office, the disclosure of which is incorporated herein in its entirety by reference.

BACKGROUND

1. Field

One or more embodiments relate to an elevator system, and more particularly, to a smart elevator system for reserving an elevator in a hotel or a building in advance, automatically calling the elevator, and automatically providing a message about a target floor.

2. Description of the Related Art

A conventional elevator system is operated manually. Thus, a person calls an elevator by pushing a call button provided around an elevator platform and presses a button of a desired floor provided in the elevator after getting into the elevator.

However, in a building under security restrictions, a person has to pass through a security gate in a lobby of the building by using a security card issued at that time and it may be difficult to track the person after he/she passes through the security, gate.

When a special person visits somebody in the building and it takes a long time to issue a security card, this may be perceived as lack of courtesy. Also, in a building that is required to have high security, it is difficult for a person to visit some persons only on a predetermined floor.

SUMMARY

One or more embodiments include a smart elevator system that, when a person who makes an online reservation approaches an elevator, may automatically call the elevator and may enable the elevator to be automatically moved to a target floor.

One or more embodiments include a smart elevator system that may track a movement path of a visitor, may automatically call an elevator, may automatically provide a message about a target floor, and may enable a door of the elevator to be opened.

Additional aspects will be set forth in part in the description which follows and, in part, will be apparent from the description, or may be learned by practice of the presented embodiments.

According to one or more embodiments, a smart elevator system includes: an elevator provided in a building having multiple floors; a controller configured to control the elevator; a portable terminal used by a person to make a reservation to use the elevator and including a communicator for long-range communication and short-range communication; a server system configured to take the reservation to use the elevator from the portable terminal by communicating with the portable terminal and control an operation of the elevator through the controller according to content of the reservation; and a portable terminal detector provided near a door of the elevator and configured to, when the portable terminal used to have made the reservation approaches, obtain a unique key of the portable terminal through the communicator.

According to an embodiment, the portable terminal may be a portable smart phone, and may include an application that displays an interface screen for making the reservation.

According to an embodiment, the portable terminal may include a global poisoning system (GPS) receiver that stores a movement path of the person, and when the movement path of the person is detected by the portable terminal detector, the movement path of the person may be transmitted to the server system and may be checked.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

The inventive concept will now be described more fully with reference to the accompanying drawings, in which embodiments of the inventive concept are shown.

Figure 1:
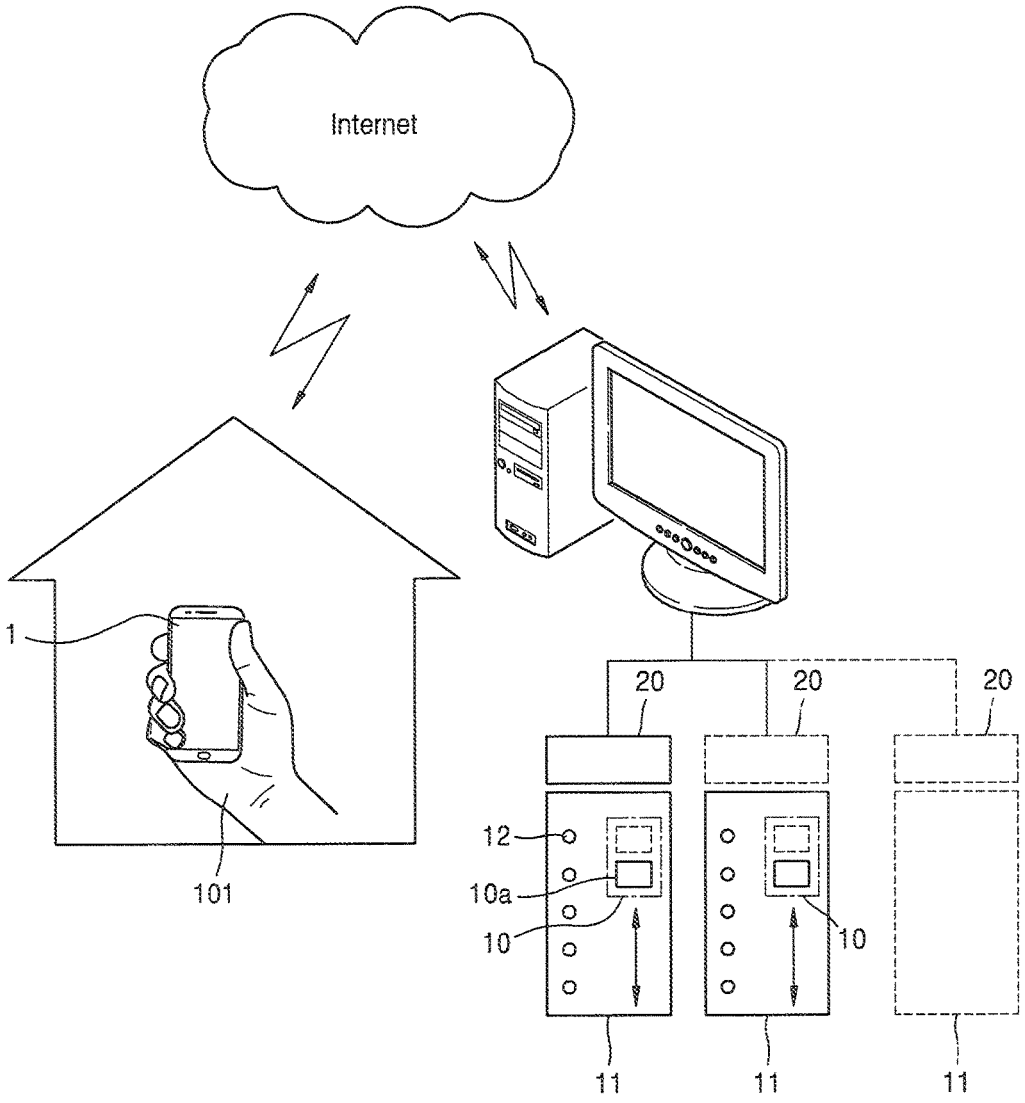
FIG. 1 is a view illustrating a schematic configuration of a smart elevator system according to an embodiment.
Figure 3:
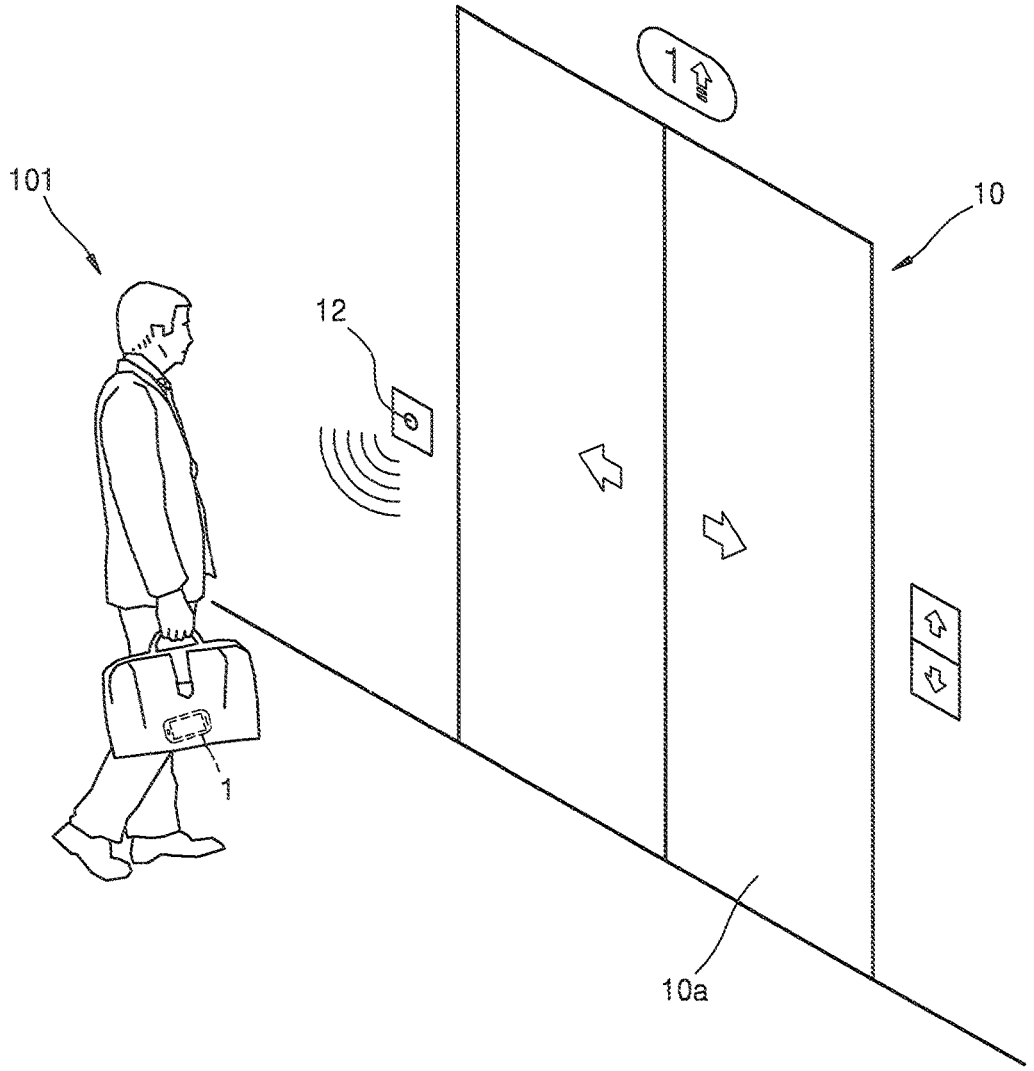
FIG. 3 is a view illustrating an example where a person who visits a building approaches a platform of an elevator.

FIG. 1 is a view illustrating a schematic configuration of a smart elevator system according to an embodiment. FIG. 3 is a view illustrating an example where a person 101 who visits on office located in a building 11 approaches a platform of the elevator 10.

The elevator 10 and a controller 20 for controlling the elevator 10 are provided in a building 11 having multiple floors. A portable terminal detector 12 is provided on each floor of the building 11. The portable terminal detector 12 may detect a portable terminal 1 owned by the person 101 who uses the elevator 10 and transmit information about the portable terminal 1 to a server system 30 through the controller 20. The server system 30 may include, as an internal element, the controller 20 that may allow the person 101 to make a reservation in advance and operate the elevator 10 according to the reservation.

The person 101 makes a reservation to visit an office in the building 11 in advance through the Internet 40 at, a place far from the building 11. The reservation is made by using an application installed in the portable terminal 1, and the reservation is transmitted to the server system 30 that controls a plurality of elevators connected to the Internet 40 through a wireless network. The server system 30 may determine whether the reservation is valid by using a security number or code received from the portable terminal 1 and transmit an acknowledgment result to the portable terminal 1.

When the person 101 approaches the platform of the elevator 10 of the building 11 at a reservation date and time, a portable terminal detector 12 determines whether the portable terminal 1 approaches through a short-range communication network such as Wi-Fi or Bluetooth (see FIG. 3), the elevator 10 is called to the platform on which the person 101 is located according to the content of the reservation, and the person 101 is allowed to get on the elevator 10. Such an operation is performed by the controller 20 under control of the server system 30 that, receives data from the portable terminal detector 12.

However, according to another embodiment, the server system 30 may transmit control information to the controller 20 and the controller 20 may perform the operation independently. The controller 20 may be a personal computer (PC)-based system When the person 101 gets into the elevator 10, a message saying welcome and a floor to which the person 101 is be moved may be provided through a broadcast system 10*a* embedded in the elevator 10. While the person 101 rides the elevator 10, whether the person 101 is in the elevator 101 may be monitored in real time by using the portable terminal detector 12 provided on each floor.

When the elevator 10 with the person 101 reaches a target floor, the broadcast system 10*a* in the elevator 10 may provide a message saying that the person 101 has reached the target floor so that the person 101 may get out of the elevator 10 on the target floor.

After the person 101 reaches the target floor, the person 101 may perform a desired activity on the target floor. When there is a room on the target floor, the portable terminal detector 12 is provided around a door of the room, and the person 101 approaches the room, the door of the room is automatically opened so that the person 101 may enter the room.

Figure 2:
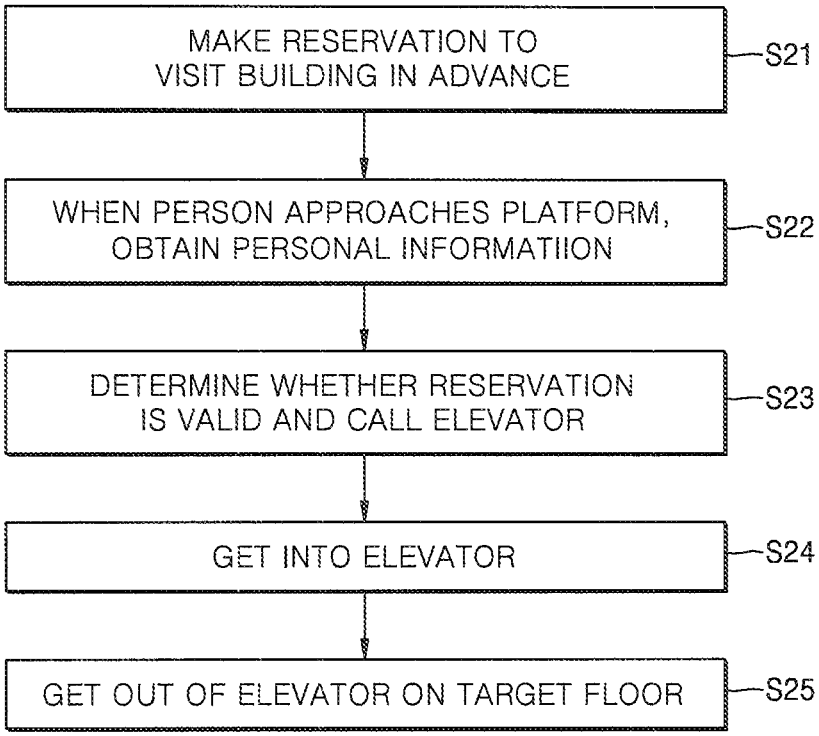
FIG. 2 is a flowchart for explaining an operation of a smart elevator system according to an embodiment.

FIG. 2 is a flowchart for explaining an operation of a smart elevator system according to an embodiment.

In operation S21, a person makes a reservation to visit an office in a building in advance by using a portable terminal.

In operation S22, when the person who has made the reservation approaches a platform (see FIG. 3) as shown in FIG. 3, encrypted personal information of the person is obtained from the portable terminal owned by the person by using, for example, a Bluetooth communication method.

In operation S23, a server system or an elevator system decrypts the encrypted personal information, determines whether the reservation is valid by using the decrypted personal information, and calls an elevator to the platform according to content of the reservation.

In operation S24, when the elevator reaches the platform and a door 10*b* is opened, the person gets into the elevator and is moved to a target floor. In this case, a security control box embedded in the elevator repeatedly checks the person in the elevator, determines whether the person is the person who has made the reservation, and moves the elevator when it is determined that the person is the person who has made the reservation.

In operation S25, when the elevator reaches the target floor, the door 10*b* of the elevator is opened, a message saying that the person has reached the target floor is provided to the person so that the person may get off the elevator. When the person still remains in the elevator, a message saying that the person needs to get off is repeatedly provided, and when it is finally determined that the person gets out of the elevator, the door 10*b* is closed.

The person who has reached the target floor and has finished his/her business may get into the elevator on the target floor, may be moved to the platform, and may walk out of the building in reverse order.

The person's visit to the building is allowed through a portable terminal detector of the building that detects a communicator of the portable terminal, and thus the person may not get into an elevator that is not reserved or may not move to a floor that is not reserved. Also, since a movement path of the person is completely monitored by detecting a position in real time from a GPS system embedded in the portable terminal, high security in the building may be maintained.

In order to realize such a system, an application for a visitor has to be provided and the person has to be registered as a user in advance through the application. A terminal that may be used in this case may be an exclusive terminal, and may be preferably a smart phone including a GPS and a long/short-range communicator.

A security control box for maintaining security in each elevator may be provided in the elevator. The security control boxy may have a function of detecting a portable terminal. The security control boxy may obtain information from the portable terminal of the person who gets into the elevator by using a Bluetooth communication method and may determine whether the person gets into the elevator in real time. The security control box may transmit encrypted person information, which is received from the server system in the security control box, and a decoder for decrypting the encrypted person information and a security number of the person to the portable terminal of the person who has made the reservation. In this case, a security technology used in ATM (Automatic Teller Machine) may be used.

The short/long-range communicator uses a wireless communication method such as Bluetooth, Wi-Fi, or long-term evolution (LTE).

According to the inventive concept, since a person who makes a reservation in advance is automatically recognized as soon as he/she reaches a lobby near a platform and an elevator is automatically called, a time taken for the person to wait for the elevator on the lobby or the platform may be reduced. Also, since the called elevator is automatically moved to a target floor that is reserved, a total time taken to use the elevator may be reduced. That is, according to the inventive concept, when the elevator is used, the elevator is called and is moved to the target floor without having to touch. According to the inventive concept, person or visitor convenience may be greatly improved and high building security may be maintained. Also, since all persons use the building based on reservations, records of access to the building may be, kept.

Figure 4:
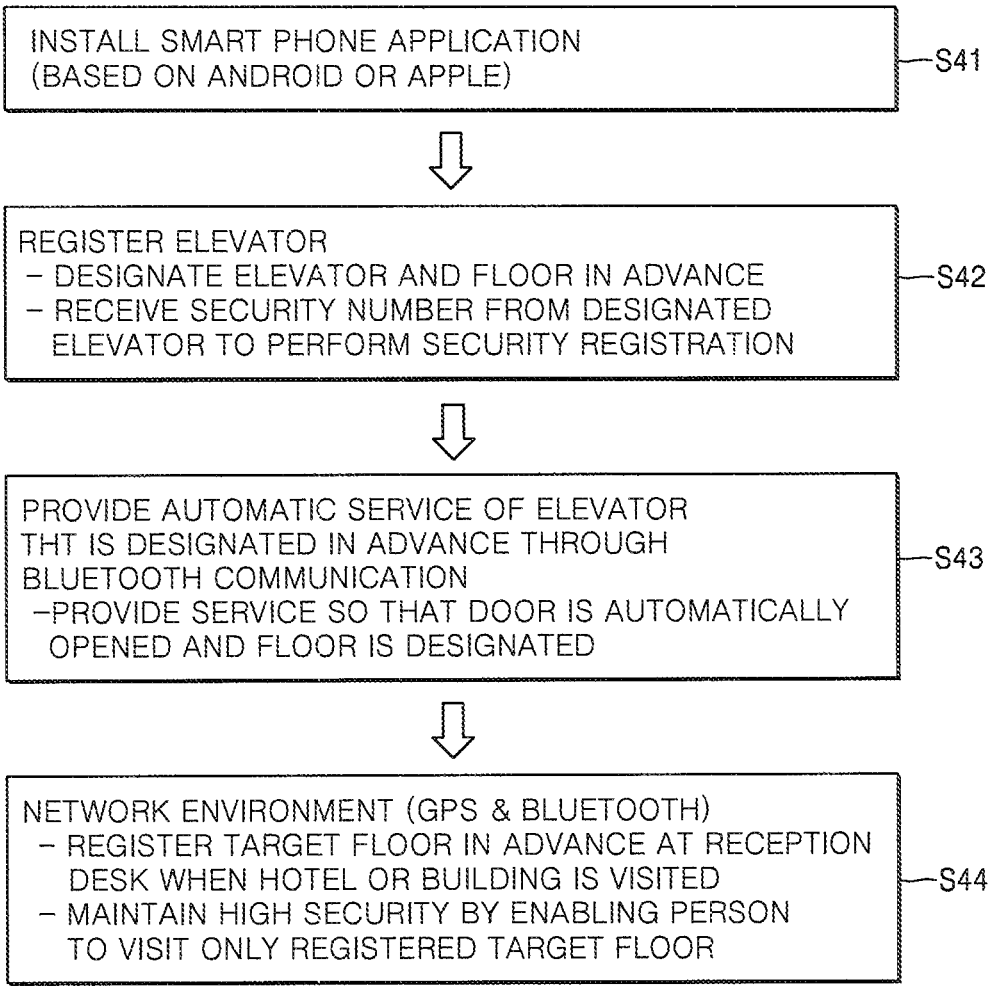
FIG. 4 is a flowchart for explaining how a user uses a smart elevator system according to an embodiment.

How a user uses a smart elevator system according to an embodiment will now be described with reference to FIG. 4.

In operation S41, a user installs an application for making a reservation to use an elevator in a terminal.

In operation S42, the user makes a reservation to use an elevator of a building which the user is to visit. In this case, the user designates the elevator and a floor to use in advance.

In operation S43, once the reservation is made, a security number is received from a security control box of the elevator to perform security registration.

In operation S44, according to the inventive concept, in the building (e.g., a hotel), a function that allows a target floor to be registered in advance at a reception desk (e.g., an information desk) of a lobby of the building may be additionally included.

According to a smart elevator system of the inventive concept, when a registered visitor designates a desired elevator and a target floor online, the desired elevator may be automatically called and may be automatically moved to the target floor. Accordingly, since the registered visitor may visit only the target floor, high security may be maintained. Also, since all movement paths of the registered visitor are automatically recorded by using a GPS or the like, safety may be secured by monitoring the all movement paths of the registered visitor.

While one or more embodiments have been described with reference to the figures, it will be understood by those of ordinary skill in the art that various changes in form and details may be made therein without departing from the spirit and scope of the disclosure as defined by the following claims.

What is claimed is:

1. A smart elevator system comprising:

an elevator provided in a building having multiple floors;

a controller configured to control the elevator;

a portable terminal used by a person to make a reservation for using the elevator and comprising a communicator for long-range communication and short-range communication;

a server system configured to receive the reservation for using the elevator from the portable terminal by communicating with the portable terminal and control an operation of the elevator through the controller according to the reservation; and a portable terminal detector provided near a door of the elevator and configured to obtain a unique key of the portable terminal through the communicator, when the portable terminal used to make the reservation approaches it, wherein a security control box is embedded in the elevator and is configured to determine whether a person getting into the elevator is the person who made the reservation and move the elevator when it is determined that the person getting into the elevator is the person who made the reservation.

2. The smart elevator system of claim 1, wherein a portable terminal detector is further provided in the elevator and is configured to determine whether the person gets out of the elevator when the elevator reaches a registered target floor and to cause the door to remain opened until the person completely gets out the elevator.

3. The smart elevator system of claim 2, wherein the portable terminal comprises a global positioning system (GPS) receiver, wherein the server system is configured to obtain a movement path of the person from the GPS receiver through the portable terminal detector and store the movement path of the person.

4. The smart elevator system of claim 1, wherein the portable terminal comprises a GPS receiver, wherein the server system is configured to obtain a movement path of the person from the GPS receiver through the portable terminal detector and store the movement path of the person.

* * * * *